United States Patent [19]

Munn

[11] Patent Number: 4,698,945

[45] Date of Patent: Oct. 13, 1987

[54] PANEL ASSEMBLY AND A METHOD OF INSTALLING SAME

[76] Inventor: John B. Munn, Bassett House, 5 Southwell Park Road, Camberley, Surrey GU15 3PU, England

[21] Appl. No.: 895,188

[22] Filed: Aug. 11, 1986

Related U.S. Application Data

[63] Continuation-in-part of Ser. No. 648,168, Aug. 28, 1984, abandoned.

[51] Int. Cl.[4] ..... E04C 2/34; E04C 2/20; E04F 15/024

[52] U.S. Cl. ..... 52/221; 52/127.7; 52/127.11; 52/571; 52/746; 52/747; 52/787

[58] Field of Search ..... 52/220, 221, 424, 563, 52/568, 569, 570, 571, 572, 746, 793, 787, 426, 747, 127.7, 127.11

[56] References Cited

U.S. PATENT DOCUMENTS

| | | | |
|---|---|---|---|
| 642,922 | 2/1900 | Reid | 52/127.8 |
| 844,944 | 2/1907 | Jacobs | 52/787 |
| 963,889 | 7/1910 | Goodwin | 52/571 X |
| 2,089,893 | 8/1937 | Greulich | 52/221 X |
| 3,100,953 | 8/1963 | Johnson | 52/570 X |
| 3,537,223 | 11/1970 | Lerchenthal | 52/571 |
| 4,051,642 | 10/1977 | Terry | 52/563 X |
| 4,118,855 | 10/1978 | Lequeux | 52/787 X |
| 4,189,125 | 2/1980 | Little | 52/569 X |
| 4,283,898 | 8/1981 | Claver | 52/787 X |
| 4,631,879 | 12/1986 | Kobayashi | 52/221 X |

FOREIGN PATENT DOCUMENTS

| | | | |
|---|---|---|---|
| 267825 | 1/1969 | Austria . | |
| 6603591 | 10/1969 | Fed. Rep. of Germany . | |
| 2151750 | 4/1973 | Fed. Rep. of Germany | 52/220 |
| 479787 | 11/1969 | Switzerland . | |
| 249980 | 4/1926 | United Kingdom | 52/563 |

*Primary Examiner*—Alfred C. Perham
*Attorney, Agent, or Firm*—Ladas & Parry

[57] ABSTRACT

A panel assembly for use in construction of flooring, walls or ceiling has two panels (1, 2) each having a planar surface (3, 4) on one side and one its opposite side (5, 6) a plurality of bosses (7, 8) projecting from the panel. The panels (1, 2) are interconnected by abuttment of the bosses (7) of one panel (1) with the bosses (8) of the other panel (2) and a locking member (12, 18) is associated with some of the abutting bosses to thereby prevent lateral movement of panel (1) relative to the other panel (2). The locking members (18) may be tubular and/or comprise locking pins (12) arranged to pass through bores in some abutting bosses. When used as a flooring the panel assembly is installed on a concrete base (26) having a substantially flat surface and bedded on an adhesive compound (25). A number of panel assemblies will be required to construct the flooring wall or ceiling, but once constructed a number of individual panels may be removed to readily allow the installation of mains services.

9 Claims, 5 Drawing Figures

PANEL ASSEMBLY AND A METHOD OF INSTALLING SAME

This is a continuation-in-part of copending application Ser. No. 648,168 filed on Aug. 28, 1984 now abandoned.

This invention relates to a panel assembly and a method of installing same and more particularly although not exclusively to such structures which are used for forming a floor, wall or ceiling in which electric cables, telephone wires, central heating pipes, etc., are located of the floor therebehind.

In present day buildings, it is often that each floor comprises a rough concrete base which is permitted to set and is subsequently substantially levelled by laying over it a sand and cement screed in which cable trays are embedded on a 1.8 m grid, for example. The flooring is then finished by laying down flooring tiles of a plastics material, for example. It is known to provide on such a finished flooring what is generally called a computer flooring which consists of a plurality of wood or metal panels of sides usually of 600 mm with adjustable legs on a lower side to define a space between the panels and the usual flooring. While the main services such as electric cables and telephone wires are located in the cable trays embedded in the concrete screed, VDU cables of a computer are normally randomly placed in the space between the wood or metal panels and the usual flooring.

The disadvantage of such an arrangement is that the concrete screed in which the cable trays are embedded takes a long time to lay and must be left to dry out for some time, perhaps a week or even longer. During this time no installation of mains services in the cable trays is permitted resulting in difficulties in allocating manpower and causing considerable inconvenience to the engineers who are to install the services. Moreover, the services must be laid within the cable tray grid resulting in high costs of materials and labour, and lack of flexibility. Furthermore, it is time consuming to adjust the height of the computer flooring to minimise any irregularities in levels of the flooring.

It is an object of the present invention to provide a panel assembly in which the above-mentioned disadvantages are substantially overcome.

According to one aspect of the present invention there is provided a panel assembly for a floor, wall or ceiling comprising two identical spaced panels being arranged to overlie one another; a plurality of support members extending outwardly from one side of each panel; a flat plannar surface on the obverse side of each panel to that side of each panel having the support members projecting therefrom, the distal ends of the support members of one panel being in abutting relationship with the distal ends of the respective support members of the other panel; two of said abutting pairs of support members having a bore through each support member, which bores are alignable coaxially; and releasable locking means located in said bores to prevent lateral movement of said one panel relative to the other panel and to prevent movement of the panels in a direction transverse to the plane of the panels, wherein said locking means includes a plurality of locking pins each one of which is mountable in the bore extending through each support member of each selected pair of abutting bosses.

Usually the panel assembly will be used as a flooring, although it will be realised that it may, with advantage, be used as a double skin as well for constructing a wall or ceiling.

In a preferred embodiment of the invention the bosses of each panel are arranged on a regular matrix. Preferably, the locking means each comprise a plurality of tubular elements each one of which is arranged to receive one of said pairs of abutting bosses.

In an alternative embodiment the locking means includes a plurality of locking pins each one of which is mountable in a bore extending through each boss of each pair of abutting bosses. Each locking pin preferably comprises a shank having a screw head at one end and a cross-pin at the opposite end therefrom, each bore being shaped to allow passage of the cross-pin therethrough.

Ribs may be located on the observe side of each panel for strengthening the panel. Conveniently, the ribs interlink the bosses. The height of each rib is 25% of the height of each boss.

Advantageously the locking means engage abutting pairs of bosses located at each corner of the panels which may be of glass reinforced plastics material.

Preferably, each panel is rectangular which includes square, with the length of each side being 900 mm, the thickness of each panel being 3.5 mm, the bosses being spaced by 108 mm and each boss having a height of 46.5 mm tapering from its base of 17 mm diameter to 10 mm diameter at the distal end thereof. Conveniently a seal can be provided around the outer peripheral edge of each panel.

The present invention is preferably applied to a floor or wall or ceiling comprising a plurality of panel assemblies each having the features referred to above.

According to another aspect of the present invention there is provided a method of installing a panel assembly which includes a panel assembly for a floor, wall or ceiling comprising two identical spaced panels being arranged to overlie one another; a plurality of support members extending outwardly from one side of each panel; a flat planar surface on the observe side of each panel to that side of each panel having the support members projecting therefrom, the distal ends of the support members of one panel being in abutting relationship with the distal ends of the respective support members of the other panel; two of said abutting pairs of support members having a bore through each support member, which bores are alignable coaxially; and releasable locking means located in said bores to prevent lateral movement of said one panel relative to the other panel and to prevent movement of the panels in a direction transverse to the plane of the panels, wherein said locking means includes a plurality of locking pins each one of which is mountable in the bore extending through each support member of each selected pair of abutting bosses, the method including laying a single layer concrete base with a substantially level surface, laying an adhesive bedding compound over the concrete base and mounting the panel assembly on the bedding compound.

The embodiment of the present invention will now be described, by way of example, with reference to the accompanying drawings, in which.

Figure 1:
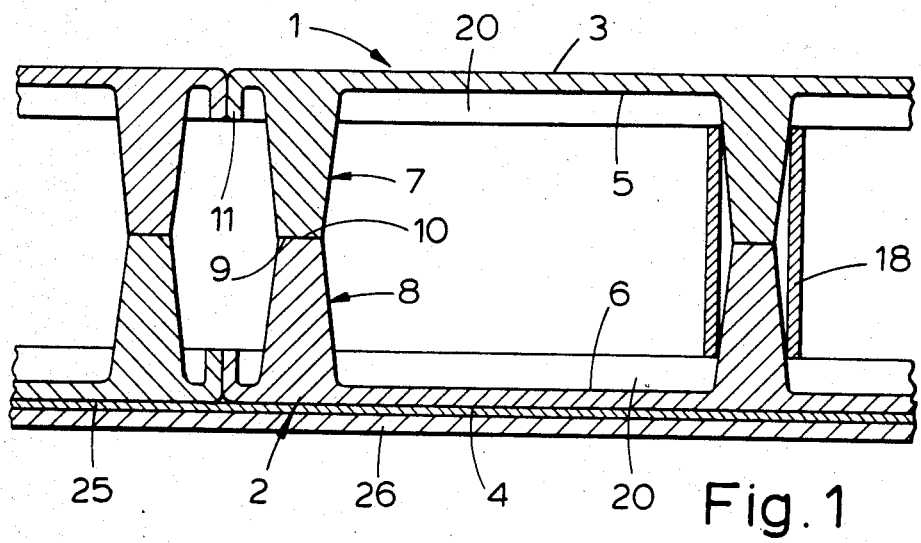
FIG. 1 is a cross-sectional view of a part of two panels mounted one upon the other to form a building structure.

Referring more particularly to the drawings, there is shown in part of two square panels 1, 2 each having an outer planar surface 3, 4 and opposed planar surfaces 5 and 6 from which project a plurality of support members or bosses 7 and 8 arranged in a regular matrix configuration. The panels 1, 2 abut each other at corresponding contacting distal surfaces 9, 10 of the bosses 7, 8. The panels 1, 2 have along each edge a flange 11 extending substantially perpendicularly to the panels in the direction of the bosses on each respective panel. The flanges may slant outwardly by approximately 1° because of the moulding process. One edge of each panel is provided with a cut-out (not shown) for lifting the panel in use.

Figure 2:
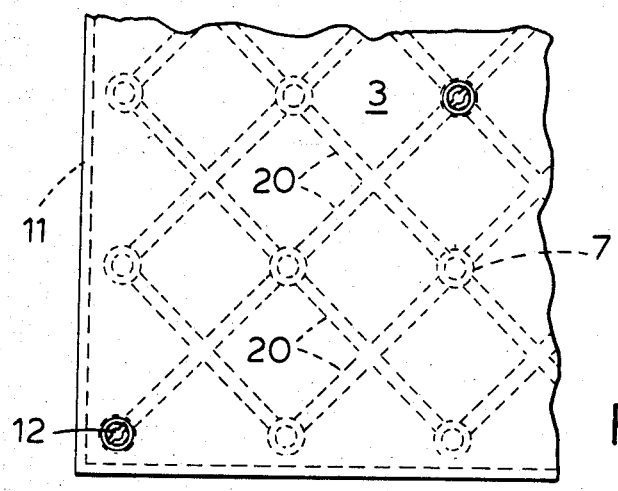
FIG. 2 is a partial plan view illustrating the array of bosses.

The bosses 7, 8 are each of a frusto conical configuration extending from the opposed planar surfaces 5, 6. Around some opposed bosses are provided a plastics ferrule 18 having an internal diameter substantially equal to the external diameter of the bosses at their junction with ribs 20 as hereinafter described, and a length equal to the combined length of the two bosses 7, 8 between the ribs. The ferrules 18 prevent lateral movement between the two panels 1, 2. Referring to FIG. 2, there is illustrated only nine bosses, although each panel 1, 2 has 81 bosses arranged on 9 boss×9 boss matrix. Only four to six of these bosses have ferrules 18 to prevent the lateral movement between the panels. The ferrules can be located at the corner bosses or at any other selected combination of bosses.

The mains services such as electrical wiring and telephone may be located as well as cables for computers in the spaces between the bosses 7, 8. Each panel is also provided with ribs 20 on the same side of the panel from which the bosses extend outwardly for strengthening the panels. The ribs interlink the bosses, and have a height which approximates to 25% of the height of each boss.

When the panel assembly is used as flooring, a single layer concrete base 26 as shown in FIG. 1 is laid with its surface being substantially level. This base is allowed to dry, whereupon an adhesive bedding compound 25 of 3 to 5 mm thick is laid over the surface of the concrete base. The panel assembly comprising panels 1, 2 is laid on the bedding compound with the surface 4 of panel 2 in contact with the bedding compound and its bosses 8 projecting upwardly. The whole flooring is laid in this manner. When various service engineers wish to lay cables, for example, they determine the locations between which the cables are to extend, lift the top panels 1 lying between these points and lay the cables in a substantially straight line or along any other path as desired. When the cable laying is completed, the panels 1 are replaced and locked onto the panels 2.

Each panel 1, 2 is a one piece moulding of glass reinforced plastics material. The moulding takes place at high temperature 140° to 150° C. and at a pressure of 500 to 1000 psi (351.5 to 703.7 $Mg/m^2$) for 3 minutes. As the panel cools, after moulding, the planar side 3, 4 of the panels cool more rapidly than the opposite side from which the bosses project because of the thick mass of material forming the bosses. Accordingly, the panels may be slightly concave on their planar side 3, 4. Consequently, when two panels are placed together as described, not all opposed contacting surfaces 9, 10 of the bosses immediately contact each other. To overcome this problem a number of the bosses, namely, the central bosses along each side of the 9×9 matrix, the boss in each corner, and each alternate boss along the diagonal between opposed corners, are provided with a central bore with diametrically extending grooves running the whole length of the bore. The bore receives a quick release plastics locking pin 12 which has an elongate shank having a screw head at one end and a cross-pin at the opposite end. The grooves of each abutting pair of bosses are aligned one with the other and are shaped to allow passage of the cross-pin therethrough so that when the locking pin is passed through the bore it is rotated, preferably through 90°, to move the cross-pin out of alignment with the grooves to overlie the panel and lock the two panels together. The locking pin has a spring beneath the screw head for holding the locking pin in position. The panel surface 3, 4 is provided with a recess at the bosses having the bores so that the locking pins do not project beyond these surfaces.

One advantage to be gained from the structure described is that the top panel 1 can be quickly and easily released by simply rotating the locking pins through 90°.

Each panel is symmetrically formed and therefore the removed panel can be replaced on the bottom panel 2 with correctly interengaging bosses even though the panel may have been rotated through 90° prior to replacement. The panels can be cut easily anywhere either for insertion of an electrical socket or alternatively to fill in a gap between the last laid panel and a wall. Where the cut occurs between adjacent bosses an elongate support, of wood for example, can be inserted between the panels parallel to the cut edges. The panels are designed to withstand pressures between the bosses of 200 kg/25 $mm^2$ but nevertheless should ideally be supported as indicated above when cut.

Small bridges may be provided within the spaces between the bosses so that telephones wires, electric cables and water pipes are separated from each other as necessary when they are run together, although such bridges are not usually required where these elements simply cross over each other.

With the flooring proposed in accordance with the present invention, it is possible to achieve a 50% reduction in wiring costs of a building including a substantial saving in costs since traditional wet screeding has been avoided. In addition, a reduction in labour costs is obtained and furthermore no trunking is required within the sand and cement screed, although some trunking laid within the panelled flooring may be provided for special wiring if necessary. However, the principal advantage with this trunking is that it need not be located specifically in tram lines at say 1.8 m spacing as in previous floor systems.

When flooring is laid it may be covered by carpeting or alternatively each panel may be provided with floor tiles or carpet tiles bonded to the panel surface 3.

The flooring structure described above is made of glass reinforced plastics material such as SY19/25/L sheet moulding compound by BTR Permali RP Limited, which when moulded produces a low profile surface. The glass content is normally 25% glass reinforcement. The flame spread is below class 2.

Each panel preferably has sides of 900 mm, is 3.5 mm thick and the bosses spaced by 108 mm have a height of approximately 46.5 mm. Each boss is 17 mm in diameter at its base and tapers to 10 mm diameter. Panels of this size are intended for use in buildings to be used as offices or for light industrial use. The panels can be utilized for heavy industrial applications, but for this use are generally thicker and bigger than those just described.

Although the structure has been described as being suitable for supporting electric cables, telephone wires or central heating pipes, the flooring structure may be provided with grills for use as ducting to extract air. The panel assembly could also be used for ducting in an air conditioning system, but it would then be necessary to adquately seal the joints between each panel assembly.

The ferrules may be omitted from the assembly described so that the locking pins are effective to both remove the dishing effect from the panels and prevent lateral movement between the panel pairs.

Figure 3:
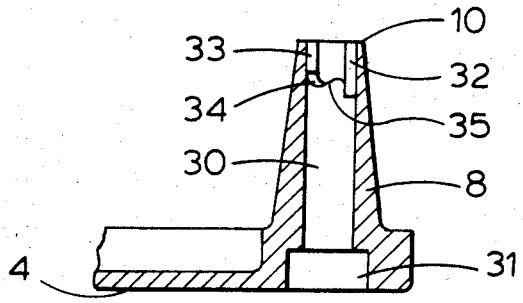
FIG. 3 is a cross-sectional view of an alternative form of one of the bosses used for locking the panels together.
Figure 4:
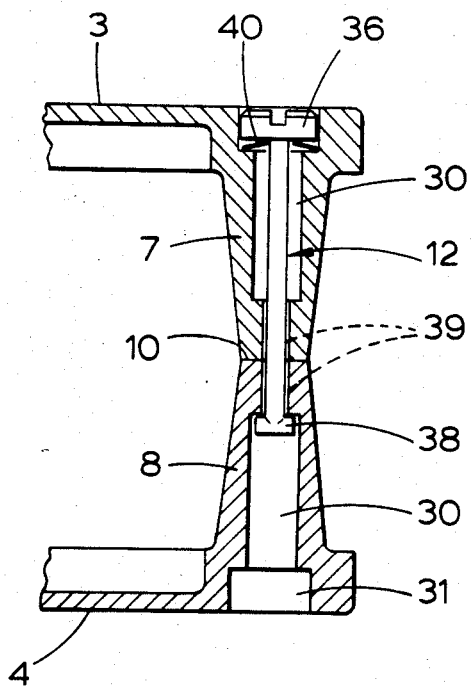
FIG. 4 is a part sectional side elevational view of another boss configuration for the panel assembly of the present invention.
Figure 5:
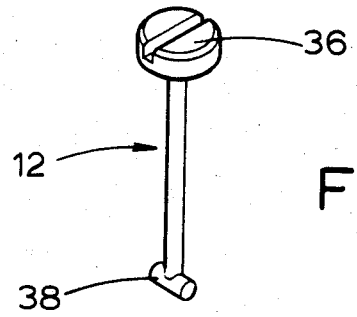
FIG. 5 is a perspective view of a cross-pin for use with the bosses shown in FIG. 4.

An alternative from of boss for use in association with a locking pin is shown in more detail in FIGS. 3, 4 and 5. The boss 8 is shown to have a central round bore 30 with an enlarged diameter portion 31 in the region of the planar surface 4 for receiving the head 36 of a locking pin 12, the head having a slot therein for engagement with a screw driver for example.

The end of the boss 8 remote from the planar surface 4 has a restricted portion 32 defined by two spaced substantially semi-circular portions 33 of which only one is shown in FIG. 3. Each portion 33 is provided with a cam surface 34 having a recessed portion 35 for receiving a cross-pin 38 of the locking pin 12.

In use, with the panels mounted one upon the other as shown in FIG. 1, two such bosses as shown in FIG. 3 face one another. The locking pin 12 is inserted through the bore 30 of boss 7 until the cross-pin 38 of the locking pin passes through a slot 39 between the portions 33 of boss 8 and clears the cam surface 34. The locking pin 12 is then rotated through 90°, whereupon the cross-pin 38 of the locking pin engages and moves along the cam surface 34 until the cross-pin is received in the recessed portion 35 of the cam surface. A spring washer 40 located under the head 37 of the locking pin holds the locking pin in this engaged position. The cam portions 33 are preferably integrally formed with the moulded panels. To release the locking pin, the pin is rotated in the opposite direction to that first described until the cross-pin 38 aligns with the slot 39 between semi-circular portions 33 whereupon the locking pin is removable from the abutting pair of bosses.

Therefore the locking pins can all be released quickly allowing removal of the uppermost panel of the panel assembly on a floor to be removed within a matter of seconds by simply turning with a screw driver through 90°.

The above described embodiments of a panel assembly according to the present invention is laid as part of a floor for example, by intially laying a single layer of concrete defining the dividing floor of a building with the concrete layer having a substantially level surface, laying an adhesive bedding compound over the said level surface and mounting the panel assembly on the bedding compound with one flat planar surface of the panel assembly lying substantially parallel with the level surface of the concrete layer. Preferably, a plurality of panel assemblies are located on the bedding compound in a side-by-side abutting manner.

I claim:

1. A panel assembly for a floor, wall or ceiling comprising two identical spaced panels being arranged to overlie one another; a plurality of support members extending outwardly from one side of each panel; a flat planar surface on the obverse side of each panel to that side of each panel having the support members projecting therefrom, the distal ends of the support members of one panel being in abutting relationship with the distal ends of the respective support members of the other panel; two of said abutting pairs of support members having a bore through each support member, which bores are alignable coaxially; and releaseable locking means located in said bores to prevent lateral movement of said one panel relative to the other panel and to prevent movement of the panels in a direction transverse to the plane of the panels, wherein said locking means includes a plurality of locking pins each one of which is mountable in the bore extending through each support member of each selected pair of abutting support members.

2. A panel assembly according to claim 1, wherein the support members of each panel are arranged on a regular matrix.

3. A panel assembly according to claim 1, wherein each support member is a boss and the releasable locking means include a plurality of locking pins each one of which is mountable in the bore extending through each boss of each said to pairs of abutting bosses, each locking pin comprising a shank having a screw head at one end and a cross-pin at the opposite end therefrom, and each bore is shaped for allowing passage of the cross-pin therethrough.

4. A panel assembly according to claim 1, including further locking means comprising a plurality of tubular elements each one of which receives one pair of abutting support members.

5. A panel assembly according to claim 4, wherein the further locking means engage abutting pairs of support members located at each corner of the panels.

6. A panel assembly according to claim 5, including ribs located on the side of each panel having the support members thereon for strengthening the panel with the ribs interlinking the support members.

7. A panel assembly according to claim 1, wherein each panel is rectangular.

8. A panel assembly according to claim 1, including a seal around the outer peripheral edge of each panel the seal comprising a peripheral flange extending transversely to the plane of the panel in the same direction as the bosses with the flange having outward inclination of 1°.

9. A method of installing a panel assembly which includes a panel assembly for a floor, wall or ceiling comprising two identical spaced panels being arranged to overlie one another; a plurality of support members extending outwardly from one side of each panel; a flat planar surface on the obverse side of each panel to that side of each panel having the support members projecting therefrom, the distal ends of the support members of one panel being in abutting relationship with the distal ends of the respective support members of the other panel; two of said abutting pairs of support members having a bore through each support member, which bores are alignable coaxially; and releasable locking means located in said bores to prevent lateral movement of said one panel relative to the other panel and to prevent movement of the panels in a direction transverse to the plane of the panels, wherein said locking means includes a plurality of locking pins each one of which is mountable in the bore extending through each support member of each selected pair of abutting support member, the method including laying a single layer concrete base with a substantially level surface, laying an adhesive bedding compound over the concrete base and mounting the panel assembly on the bedding compound.

* * * * *

UNITED STATES PATENT AND TRADEMARK OFFICE

CERTIFICATE OF CORRECTION

PATENT NO. : 4,698,945

DATED : October 13, 1987

INVENTOR(S) : John B. Munn

It is certified that error appears in the above-identified patent and that said Letters Patent is hereby corrected as shown below:

On the data and Abstract page, insert -- [30] Foreign Application Priority Data, U.K. 8300180 filed January 5, 1983 --.

On the data and Abstract page, item "[63]", after "abandoned" insert -- and PCT/GB84/00002 filed January 5, 1984 --.

Column 1, line 7, after "abandoned" insert -- and PCT/GB84/00002 filed January 5, 1984 --.

Signed and Sealed this

Sixteenth Day of February, 1988

*Attest:*

*Attesting Officer*

DONALD J. QUIGG

*Commissioner of Patents and Trademarks*